US005111791A

United States Patent [19]

Onodera

[11] Patent Number: 5,111,791

[45] Date of Patent: May 12, 1992

[54] CYLINDER HEAD AND VALVE TRAIN ARRANGEMENT FOR MULTIPLE VALVE ENGINE

[75] Inventor: Hiroki Onodera, Iwata, Japan

[73] Assignee: Yamaha Hatsudoki Kabushiki Kaisha, Iwata, Japan

[21] Appl. No.: 623,698

[22] Filed: Dec. 7, 1990

Related U.S. Application Data

[62] Division of Ser. No. 483,404, Feb. 13, 1990, Pat. No. 5,016,592.

[30] Foreign Application Priority Data

| | | | |
|---|---|---|---|
| Feb. 14, 1989 | [JP] | Japan | 1-32587 |
| Feb. 14, 1989 | [JP] | Japan | 1-32588 |
| Feb. 14, 1989 | [JP] | Japan | 1-32589 |
| Mar. 31, 1989 | [JP] | Japan | 1-78302 |

[51] Int. Cl.[5] ..... F02B 15/00

[52] U.S. Cl. ..... 123/432; 123/90.6; 123/90.22; 123/90.27; 123/315

[58] Field of Search ..... 123/90.22, 90.27, 90.6, 123/90.31, 432, 315

[56] References Cited

U.S. PATENT DOCUMENTS

| | | | |
|---|---|---|---|
| 1,623,826 | 4/1927 | Burleson | 123/90.28 |
| 3,137,283 | 6/1964 | Sampietro | 123/90.6 |
| 4,350,126 | 9/1982 | Honda | 123/432 |
| 4,593,657 | 6/1986 | Aoi et al. | 123/90.6 |
| 4,635,592 | 1/1987 | Weichsler | 123/315 |
| 4,658,780 | 4/1987 | Hosoi | 123/432 |
| 4,671,228 | 6/1987 | Tomita et al. | 123/432 |
| 4,716,864 | 1/1988 | Binder | 123/90.27 |
| 4,750,455 | 6/1988 | Ebesu | 123/90.27 |
| 4,932,377 | 6/1990 | Lyle | 123/308 |
| 5,014,655 | 5/1991 | Ampferer | 123/90.27 |

FOREIGN PATENT DOCUMENTS

| | | | |
|---|---|---|---|
| 0235121 | 9/1987 | European Pat. Off. | 123/432 |
| 0344599 | 12/1989 | European Pat. Off. | 123/90.17 |

*Primary Examiner*—E. Rollins Cross
*Assistant Examiner*—Thomas N. Moulis
*Attorney, Agent, or Firm*—Ernest A. Beutler

[57] ABSTRACT

A cylinder head and valve train mechanism for an internal combustion engine having six valves per cylinder. There are provided four intake valves and two exhaust valves. In some embodiments, the size of the intake valves is varied because they are served by a common port so as to insure equal flow to the cylinder through all valves. In one embodiment, a single insert forms two of the valve seats. Also, two of the four valves are disposed at acute angles to both a plane containing the cylinder bore axis and a perpendicular plane passing through this axis in many embodiments. In these embodiments, the cam lobes that operate the angularly disposed valves have cam surfaces that are inclined relative to the axis of rotation of the camshaft. In some embodiments, all of the intake valves are operated by a single camshaft. In other embodiments, two camshafts operate different pairs of the intake valves. Various bearing arrangements for the camshafts are illustrated and described.

16 Claims, 10 Drawing Sheets

CYLINDER HEAD AND VALVE TRAIN ARRANGEMENT FOR MULTIPLE VALVE ENGINE

This is a division of U.S. patent application Ser. No. 483,404, filed Feb. 13, 1990, now U.S. Pat. No. 5,016,592.

BACKGROUND OF THE INVENTION

This invention relates to a cylinder head and valve train arrangement for a multiple valve engine and more particularly to an arrangement for improving the performance of an engine through the use of multiple valves and permitting a simple and highly effective construction to achieve this result.

It has been basically understood that the performance of an internal combustion engine can be improved by improving the breathing of the intake charge into the combustion chamber and the exhaust charge from the combustion chamber. It is also well known that the breathing and volumetric efficiency of an engine can be improved by increasing the number of valves rather than merely providing a single extremely large intake valve and a single extremely large exhaust valve. By using multiple smaller valves, the inertia can be reduced and higher engine speeds obtained. However, there still is a significant problem in placing all of the components within the combustion chamber and also insuring that the combustion chamber has a proper configuration.

In high performance engines at the present time, four valves per cylinder are now becoming increasingly common. Such arrangements all employ two intake valves and two exhaust valves per chamber. It has been proposed also to employ arrangements with five valves (three intake and two exhaust) so as to permit even further increases in performance. Although it was thought that five valves per cylinder might be the optimum number, considering the problems in connection with valve placement and valve actuation, it is now believed that the provision of six valves (four intake and two exhaust) can offer still further performance increases. However, there are a wide variety of problems in connection with the provision of so many valves in a single combustion chamber.

It is, therefore, a principal object of this invention to provide an improved cylinder head arrangement for an internal combustion engine employing six valves for each cylinder.

It is a further object of this invention to provide an improved cylinder head arrangement that employs four intake valves and two exhaust valves per cylinder.

One problem attendant with the provision of a large number of valves for the engine is the porting arrangement for the individual valves. If individual ports are provided for each valve, then the cylinder head configuration becomes extremely complicated. On the other hand, if the valves are siamese so that a plurality of valves are served by a common port, this can give rise to flow irregularities through the individual valves and less than adequate utilization of the valve area.

It is, therefore, a still further object of this invention to provide an improved multiple valve arrangement for an internal combustion engine having siamese porting and insuring equal flow through all of the valves.

It is a further object of this invention to provide an improved porting arrangement for a multiple valve engine wherein a single port serves all valves and wherein the flow through all of the valves will be equal.

In connection with the use of multiple valves for an engine, it is also desirable to use light alloy materials for the cylinder head. However, when light alloy cylinder head materials are employed, it is the practice to use some form of valve seat insert for actually forming the seating surface of the valve. Such inserts are normally pressed in or inserted into the cylinder head material in some similar manner. However, when multiple valves are employed, the cylinder head surface may not be able to accept such a wide number of inserts.

It is, therefore, a still further object of this invention to provide an improved valve arrangement for an engine wherein a single insert forms a plurality of valve seats.

In connection with the utilization of multiple valves, it is, of course, desirable to minimize the number of camshafts employed for operating all of the valves. Generally, it has been the practice with four and five valve per cylinder engines to employ two camshafts, one for operating the intake valves and one for operating the exhaust valves. However, when one camshaft is called upon to operate more than three valves, then the placement of the valves can be compromised. Specifically, if there are four valves per cylinder operated by a single camshaft, it is normally the practice to align the valves so that they all reciprocate along axes that lie in a plane that will intersect or pass near the rotational center of the camshaft axis. This means that the actual length of the camshaft and specifically the lobes require the valves to be all positioned so that the combustion chamber configuration tends to be large and provide large surface areas. This obviously reduces the possible compression ratio of the engine and, accordingly, its performance.

It is, therefore, a still further object of this invention to provide an improved arrangement for operating multiple valves from a single camshaft and wherein the valves can reciprocate about axes that are not within a common plane so as to facilitate improved combustion chamber configuration.

It is a further object of this invention to provide an improved camshaft operating arrangement for an engine wherein the valve placement and camshaft construction is such that the combustion chamber configuration need not be compromised and yet a single camshaft can be employed to operate multiple valves.

In conjunction with the use of a single camshaft for operating multiple valves, it is frequently the practice to employ separate cam lobes for operating each individual valve or groups of valves. However, where there are multiple valves and the use of multiple cam lobes, then the rotational support for the camshaft presents some problem. That is, the highest axial loading on the camshaft occurs in the area of the cam lobes where they engage the valve actuating elements. However, if the cam lobes are all placed close to each other, it is difficult if not impossible to provide a bearing surface adjacent the cam lobes in order to take these side loadings. Conventional camshaft arrangements simply do not afford the opportunity to provide adequate bearing surfaces for the camshafts under these circumstances.

It is, therefore, a further object of this invention to provide a camshaft arrangement for a multiple valve engine wherein the cam lobes can be spaced widely enough apart so as to afford adequate bearing surface.

It is a further object of this invention to provide an improved bearing arrangement for a multiple valve actuating camshaft for an engine.

In some instances with multiple valve engines, it may be desirable to employ more than two camshafts for driving all of the valves of the engine. Where such an arrangement is employed, however, then it becomes important to insure that all of the camshafts are driven in the same timing relative to the engine output shaft. However, the timing drive should be relatively simple, uncomplicated and afford ready access to the components of the engine.

It is, therefore, a further object of this invention to provide an improved camshaft drive arrangement for driving at least three camshafts from the engine output shaft.

SUMMARY OF THE INVENTION

A first feature of this invention is adapted to be embodied in a cylinder head arrangement for an overhead valve engine. The cylinder head defines in part a combustion chamber with an associated cylinder. A set of only four poppet valves are supported for reciprocation within the cylinder heads and have their head portions lying substantially on one side of a plane passing through the center of the cylinders when the four poppet valves are closed. A set of only two poppet valves are supported for reciprocation by the cylinder head and have their head portions lying substantially on the other side of the plane when they are closed. One set of valves comprise inlet valves and the other set comprise exhaust valves.

A further feature of the invention is adapted to be embodied in a valve arrangement for an overhead valve internal combustion engine that is comprised of a cylinder head forming at least in part a combustion chamber. A pair of valve seats are formed in the cylinder head and a single siamese port extends from an end through the cylinder head and terminates at the valve seats. The valve seats define different area ports for providing uniform flow between the combustion chamber and the end of the siamese port to insure equal volume of flow past the valve seats in compensation for different flow resistance caused by the siamese port between the valve seats and the end.

Another feature of the invention is adapted to be embodied in a valve arrangement for an overhead valve internal combustion engine that comprises a cylinder head having a surface defining in part a combustion chamber. A pair of valve ports are formed in the cylinder head by a single valve insert that defines two separate valve seats. A pair of poppet valves are supported for reciprocation within the cylinder head and each cooperate with a respective one of the valve seats for controlling the flow therethrough.

Another feature of the invention is adapted to be embodied in a valve train arrangement for an internal combustion engine that comprises a cylinder defining a bore for receiving a piston. A cylinder head is affixed relative to the cylinder and has a surface defining with the bore and the piston a combustion chamber. A pair of poppet valves are supported for reciprocation relative to the cylinder head about axes that are disposed in non parallel relation to each other. One of the axes is inclined at an acute angle only to a first plane containing the axis of the bore. The other of the axes is inclined at an acute angle to the first plane and also at an acute angle to a second plane that is perpendicular to the first plane and which also passes through the bore axis. A camshaft is supported for rotation about an axis that is parallel to the first plane and has first and second cam lobes for operating the first and second valves respectively. The second cam lobe has its cam surface extending in a direction that is inclined to the rotation of axis of the camshaft.

Yet another feature of the invention is adapted to be embodied in a camshaft arrangement for operating a plurality of cam followers for valves associated with a single cylinder of an internal combustion engine. The camshaft has a first lobe for operating a first of the cam followers and a second lobe for operating the second of the cam followers. The surfaces of at least one of the cam lobes engaged with the respective follower is offset from the center of the cam lobe surface for increasing the distance between the cam lobes relative to the distance between the followers to provide a greater length of the camshaft between the cam lobes for bearing area.

A still further feature of the invention is adapted to be embodied in a camshaft drive arrangement for an internal combustion engine having an output shaft. At least three camshafts are journaled for rotation about respective axes relative to the cylinder head. Each of these camshafts operates a plurality of valves in the cylinder head. First drive means are provided for driving at least one of the camshafts from the engine output shaft and second drive means drive at least another of the camshafts from the one camshaft.

DETAILED DESCRIPTION OF THE PREFERRED EMBODIMENTS OF THE INVENTION

Referring first to the embodiment of FIGS. 1 through 4, an internal combustion engine depicted in accordance with this embodiment is illustrated partially. Since the invention relates primarily to the construction of the cylinder head assembly, the valve train, porting arrangement associated with it and camshaft drive, only this portion of the engine has been shown in detail.

Figure 2:
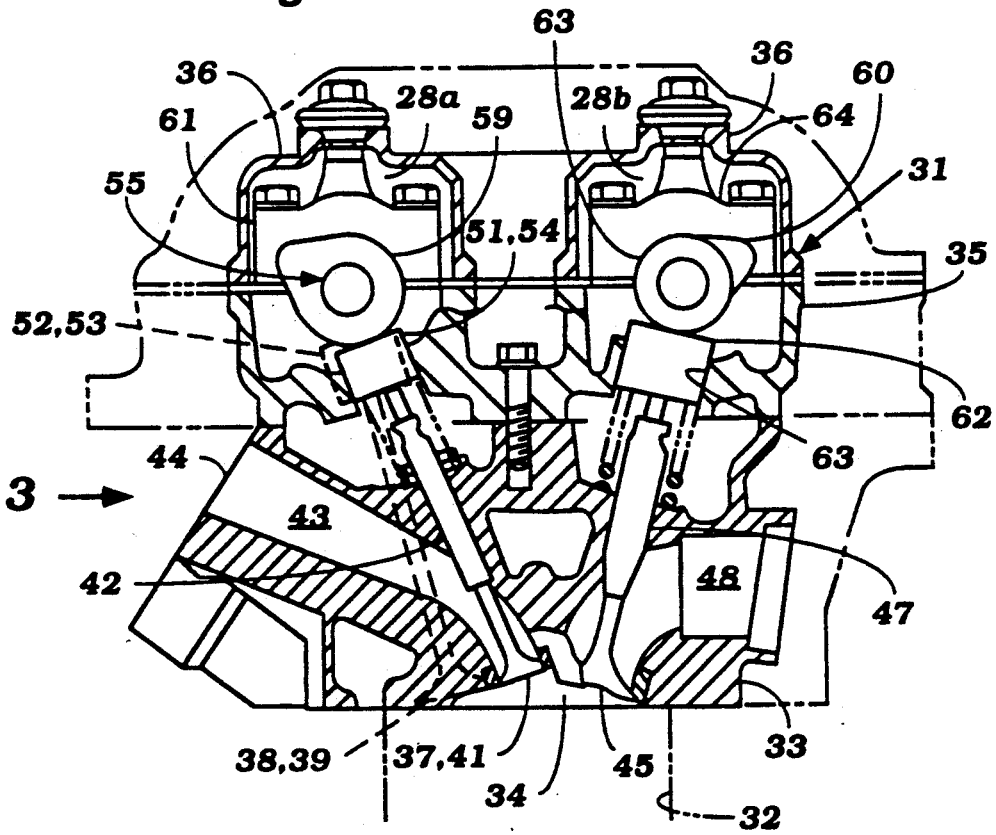
FIG. 2 is an enlarged cross sectional view taken along the line 2—2 of FIG. 1.
Figure 3:
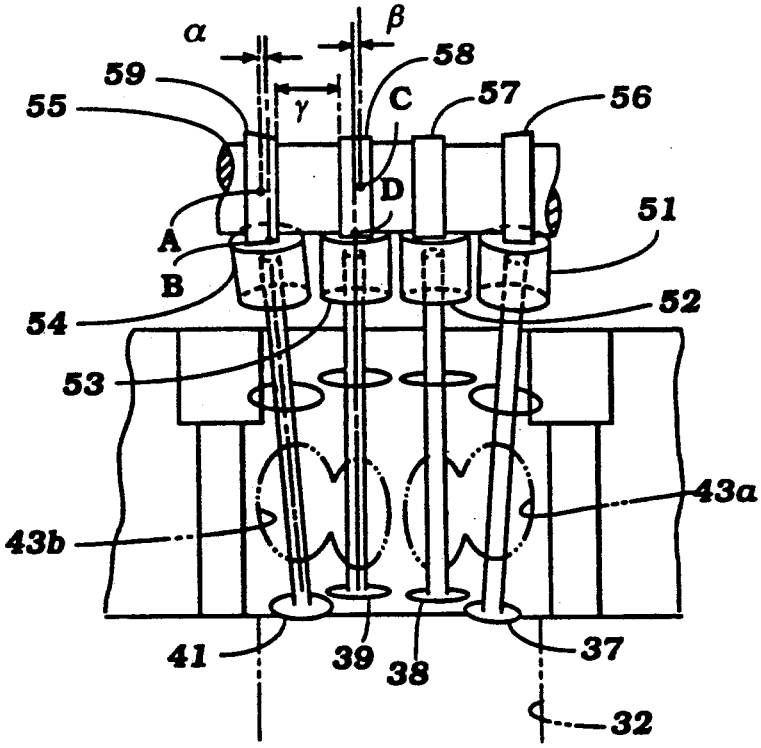
FIG. 3 is a side elevational view, in part schematic, looking generally in the direction of the arrow 3 in FIG. 2.
Figure 4:
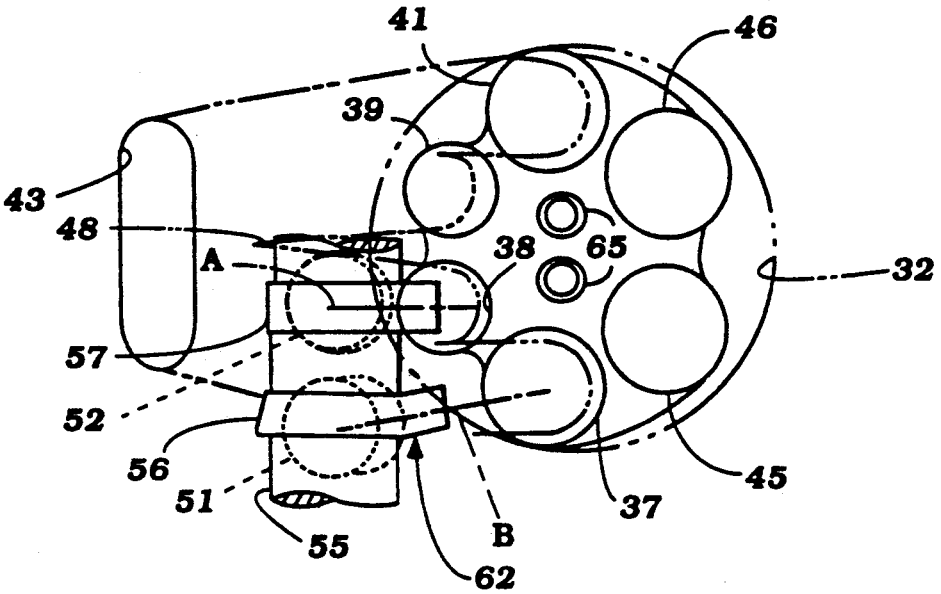
FIG. 4 is an enlarged top plan view with certain components shown in phantom for reference.

It is to be understood, however, that the cylinder head assembly, which in this embodiment is identified generally by the reference numeral 31, is associated with a cylinder block having a plurality of aligned cylinder bores, shown in phantom in FIGS. 2 through 4 and identified generally by the reference numeral 32. In the illustrated embodiment, the engine is of the in line type. It is to be understood, however, that the invention can be utilized in conjunction with engines having other cylinder configurations. Also, certain facets of the invention can be utilized in conjunction with engines having cylinders that are not cylindrical bores. For that reason, the term "bore" as used in the specification and claims is intended to encompass cylinders having openings in which pistons are supported for reciprocation regardless of the cross sectional configuration.

In the illustrated embodiment, the cylinder head assembly 31 is made up of a plurality of light alloy castings including a main cylinder head casting 33 in which recesses 34 are formed so as to define combustion chambers with the cylinder bores 32 and the pistons reciprocating therein. The pistons are not illustrated in the drawings.

In addition to the main cylinder head casting 33, the cylinder head assembly further includes a cam carrier 35 which, as will be noted, contains the valve actuators and camshafts and a pair of cam covers, each indicated generally by the reference numeral 36. The cam covers 36, the camshaft carrier 35 and cylinder head 33 may be affixed to the associated cylinder block in any known manner.

The cylinder head assembly 31 is provided with a set of four intake valves 37, 38, 39 and 41, each of which has stem portions that are slidably supported for reciprocation within a respective guide 42 pressed into the cylinder head portion 33. It will be noted that the stems of the center intake valves 38 and 39 reciprocate about respective axes that extend parallel to each other and which define a common plane that is disposed at an acute angle to a plane passing through the center of the bore 32, extending perpendicularly to the plane of FIG. 2, and lying within a plane parallel to the plane of FIG. 3.

The outer or side intake valves 32 and 34 reciprocate about axes that are in a common plane in a direction parallel to the plane of reciprocation of the axes of reciprocation of the intake valves 38 and 39 and which are disposed at an acute angle to the aforenoted plane of the cylinder bore. The acute angle of the intake valves 37 and 41 relative to this plane is greater than the acute angle of the plane defined by the axes of reciprocation of the intake valves 38 and 39. However, the axes of reciprocation of the intake valves 37 and 41 also lie at an acute angle to a plane perpendicular to the aforenoted plane and passing through the cylinder axes. This perpendicular plane is parallel to the plane of FIG. 2 and perpendicular to the plane of FIG. 3. As a result of this acute angle, it should be noted that the tips of the stems of the valves 37 and 41 are disposed outwardly of the periphery of the cylinder 32.

The intake valves 37, 38, 39 and 41, and specifically the head portions thereof, open and close respective valve seats formed by pressed in inserts. These valve seats define intake ports which all are served by a common, siamese intake passage 43 that extends from an oval opening in a face 44 of the cylinder head to these valve ports.

As may be best seen from FIG. 4, the intake valves 38 and 39 are much closer to the inlet opening of the intake passage 43 and the gases flowing to the intake valves 38 and 39 have a straighter path than the situation with respect to the intake valves 37 and 41. If it is desired to provide substantially uniform flow into the cylinder 32 through all of the intake ports served by the valves 37, 38, 39 and 41, then the valves 37 and 41 should be made with their heads of a larger diameter than the heads of the valves 38 and 39 as shown in FIG. 4.

The cylinder head assembly 31 also supports a second set of valves comprising exhaust valves 45 and 46 which lie generally on the opposite side of the first mentioned plane when these valves are in their closed position. The valves 45 and 46 have their stem portions supported for reciprocation within pressed in guides 47 and reciprocate along parallel axes that lie in a common plane that is disposed at an acute angle to the aforenoted plane. This acute angle is less than the acute angle of the valves 37 and 41 but greater than the acute angle of the valves 38 and 39.

In the embodiment of FIGS. 1 through 4, the heads of the intake valves 37 and 41, although larger than the heads of the intake valves 38 and 39, are slightly smaller than or equal to the diameter of the heads of the exhaust valves 45 and 46. The exhaust valves 45 and 46 control the flow through one or more exhaust ports 48 formed in the side of the cylinder head portion 31 opposite to the intake port 43.

With respect to the configuration of the intake port 43, it has been noted that it starts from a common opening but as it approaches the valves 37 and 38 and 39 and 41, it will branch into two portions 43*a* and 43*b* as best shown in FIG. 3. A small dividing wall 48 extends between and divides these passageways 43*a* and 43*b* as may be best seen in FIG. 4.

The intake valves 37, 38, 39 and 41 are all operated by respective thimble tappets 51, 52, 53 and 54 that are slidably supported in bores formed in the cam carrier 35. These bores are disposed so as to be parallel to the respective valve stems 42 of the valves which they operate. As a result, the bores that support the tappets 52 and 53 have their central axes disposed in a common plane, that is at an acute angle to the first noted plane passing through the center of the cylinder bore, while the axes of reciprocation of the tappets 51 and 52 lie in a plane that is at an acute angle to this plane and also at an acute angle to the perpendicular plane aforenoted. As a result, the head portions of the tappets 51, 52, 53 and 54 will not all be in a common plane. Those of the tappets 52 and 53 are in a common plane, but those of the tappets 51 and 54 are skewed to this common plane.

Coil compression springs and keepers act to urge the valves 37, 38, 39 and 41 toward their closed positions. The valves are opened by means of a camshaft assembly now to be described.

An intake camshaft, indicated generally by the reference numeral 55 is journaled for rotation, in a manner to be described, by the cylinder head assembly 31 and specifically between the cam carrier 35 and bearing caps which will be described. The camshaft 55 rotates about an axis that is disposed parallel to the axis of rotation of the engine crankshaft (not shown). In this embodiment, the camshaft 55 is provided with individual cam lobes 56, 57, 58 and 59 having a configuration to be described, each of which cooperates with a respective one of the thimble tappets 51, 52, 53 and 54 in a manner to be described.

The cam carrier 35 is formed with individual integrally formed bearing surfaces that cooperate with bearing surfaces formed on the camshaft 55 between the respective cam lobes 56, 57, 58 and 59. Bearing caps 61 are affixed to the cam carrier 35 in a known manner.

Figure 1:
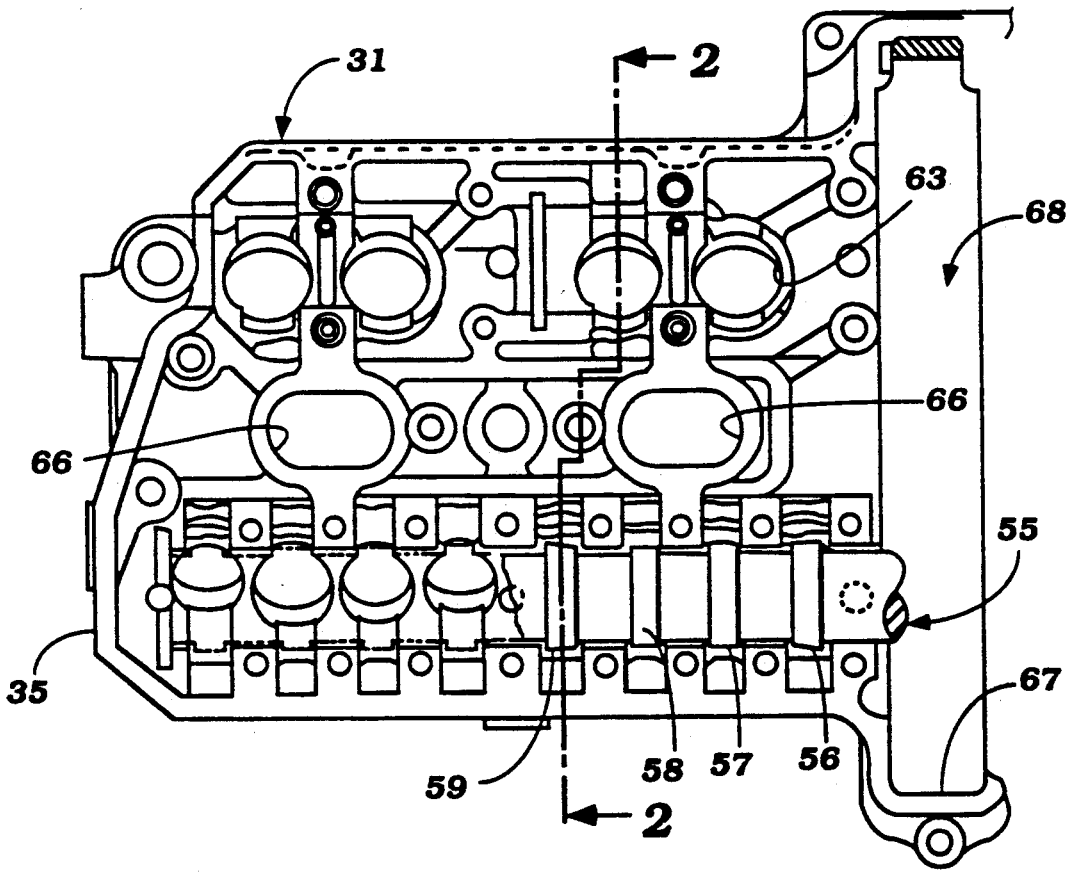
FIG. 1 is a top plan view of a cylinder head assembly of an internal combustion engine constructed in accordance with an embodiment of the invention with the camshaft cover and certain elements of the valve train removed and other parts broken away and shown in section.

As has been previously noted, the pair of center intake valves 37 and 41 are disposed not only at an acute angle to the aforenoted first mentioned plane containing the axis of the cylinder bore, but also at an acute angle to a perpendicular plane. As a result, in order to achieve proper operation of the valves and a compact configuration, the thimble tappets 51 and 54 are so disposed. To further facilitate this operation and as best seen in FIGS. 1, 3 and 4, the cam lobes 56 and 59 are disposed so that their heel portions are, rather than cylindrical, as is typical with the normal tappets and specifically with the normal cam lobes 57 and 58, at an angle. In addition, the lobe portions 62 of these cams are disposed at an angle as shown in FIG. 4 so that the lobes 62 of the cams 56 and 59 will engage the tappets 51 and 54 along a generally straight line and there will be very little sliding contact therebetween. As a result, very little wear will occur. Also, the cam lobes 56 and 59 may be disposed axially beyond the periphery of the cylinder bore 32. The heel portion of the cam lobes 56 and 59 is similarly tapered.

Furthermore, in order to achieve a maximum bearing area and a larger bearing area that would be possible if the cam lobe configuration were more conventional, the cam lobes 56 and 59 are disposed so that their center points A are disposed outwardly by a distance $\alpha$ from the point of contact B with the thimble tappets 51 and 54. In a similar manner, the cam lobes 57 and 58 are disposed in an offset relationship so that their center points C are disposed at a distance $\beta$ from the point of contact D with the thimble tappets 52 and 53. As a result, there can be a greater distance between the cam lobes 56 and 57, and 58 and 59 $\gamma$ than if the contact was symmetric.

The exhaust valves 45 and 46 are actuated in a generally similar manner to the intake valves 37, 38, 39 and 41. However, due to their alignment, the exhaust valves 45 and 46 are operated by respective thimble tappets 62 that are slidably supported within bores 63 formed in the cam carrier 35 and which bores have their center lines lying in a plane common to the plane of the axis of reciprocation of the valves 45 and 46. An exhaust camshaft 63 is journaled in an appropriate manner in the exhaust side of the cam cover 36 by means of bearings formed integrally in the cam carrier 45 and bearings formed by bearing caps 64 that are affixed in a suitable manner within this cam chamber.

Consistent with the desire to provide high performance, the combustion chamber 34 may be provided with a pair of spark plugs 65 that are disposed, in this embodiment, with their gaps in side by side relationship aligned axially along the axis of rotation of the output shaft and lying substantially on the first mentioned plane containing the axis of the cylinder bore 32. The spark plugs 65 are accessible through spark plug wells 66 (FIG. 1) formed centrally in the cylinder head assembly 31 and which may be opened through the area between the cam covers 36.

Forwardly at one end of the cylinder head assembly 31, there is provided a chain case or timing case 67 in which a timing chain or belt 68 is contained that is driven from the output shaft of the engine in a known manner. This timing chain or belt 68 cooperates with suitable sprockets (not shown) attached to the camshafts 59 and 63 for driving them at one half of crankshaft speed, as is well known in this art.

In the embodiment of FIGS. 1 through 4, the spark plugs 65 were disposed so that they were spaced apart from each other along the axis of rotation of the output shaft. As such, they are disposed between the center intake valves 37 and 41 and, accordingly, the placement of the spark plugs 65 limits the maximum size of the intake valves 41 and 37. In this regard, it should be noted that the intake valves 37 and 41 are disposed so that their peripheral edges are closer to the periphery of the cylinder bore 32 than the intake valves 38 and 39 and also than the exhaust valves 45 and 46. It is desirable to maintain the periphery of the valves 37 and 41 close to the axis of the bore 32 while moving the valves 38 and 39 somewhat inwardly from this periphery.

Figure 5:
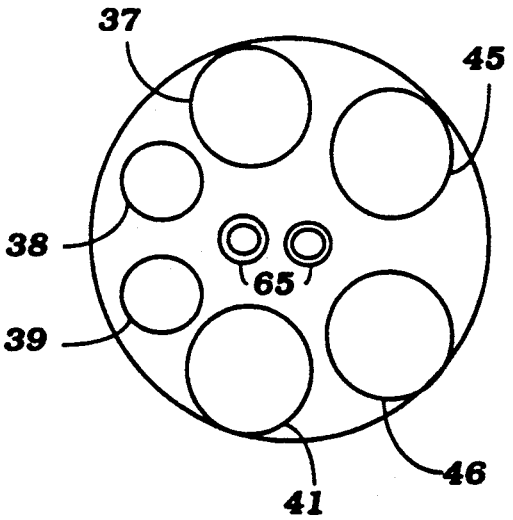
FIG. 5 is a bottom plan view of the cylinder head showing the valve and spark plug arrangement in accordance with another embodiment of the invention.

If it is desired to further increase the diameter of the heads of the valves 37 and 41, then it may be desirable to reposition the spark plugs 65 so that, rather than lying on the first mentioned plane, they lie on the second mentioned plane. Such an embodiment is shown in FIG. 5. Because of the similarity of this embodiment to the previously described embodiment, all components have been identified by the same reference numeral. The full illustration of the valve actuating mechanism is not believed to be necessary to understand how the invention can be employed in conjunction with this embodiment. It should be readily apparent from this figure that, not only can the intake valves 37 and 41 be enlarged in head diameter, but the same can be true with respect to the exhaust valves 45 and 46 without adversely effecting the cylinder head integrity or the positioning of the spark plugs.

Figure 6:
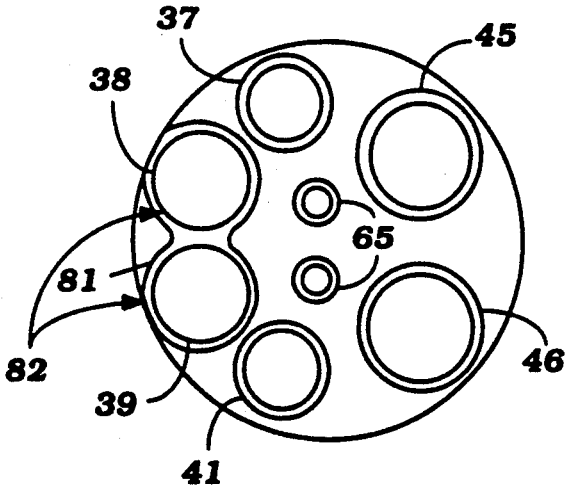
FIG. 6 is a bottom plan view, in part similar to FIG. 5, and shows yet another embodiment of the invention.

In the embodiments as thus far described, it should be readily apparent that the provision of a plurality of valves and specifically more than five valves per combustion chamber clearly complicates the cylinder head configuration and the difficulty of providing individual seat inserts for each of the valves. FIG. 6 shows another embodiment of the invention wherein the cylinder head is provided with a common valve insert indicated generally by the reference numeral 101 which is provided with individual port openings 102 that serve each of the intake valves 38 and 39. As a result, the cylinder head configuration can be made more compact and the number of valve inserts can be substantially reduced. In this embodiment, the placement of the spark plugs 65 is the same as that shown in the embodiment of FIGS. 1 through 4. Also, in the illustrated embodiment of FIG. 6, the intake valves 37, 38, 39 and 41 all have the same diameter as opposed to the use of larger intake valve heads for the valves 37 and 41 than the valves 38 and 39. Of course, it is to be understood that the valve size and spark plug location can be varied without departing from this embodiment of the invention.

Figure 7:
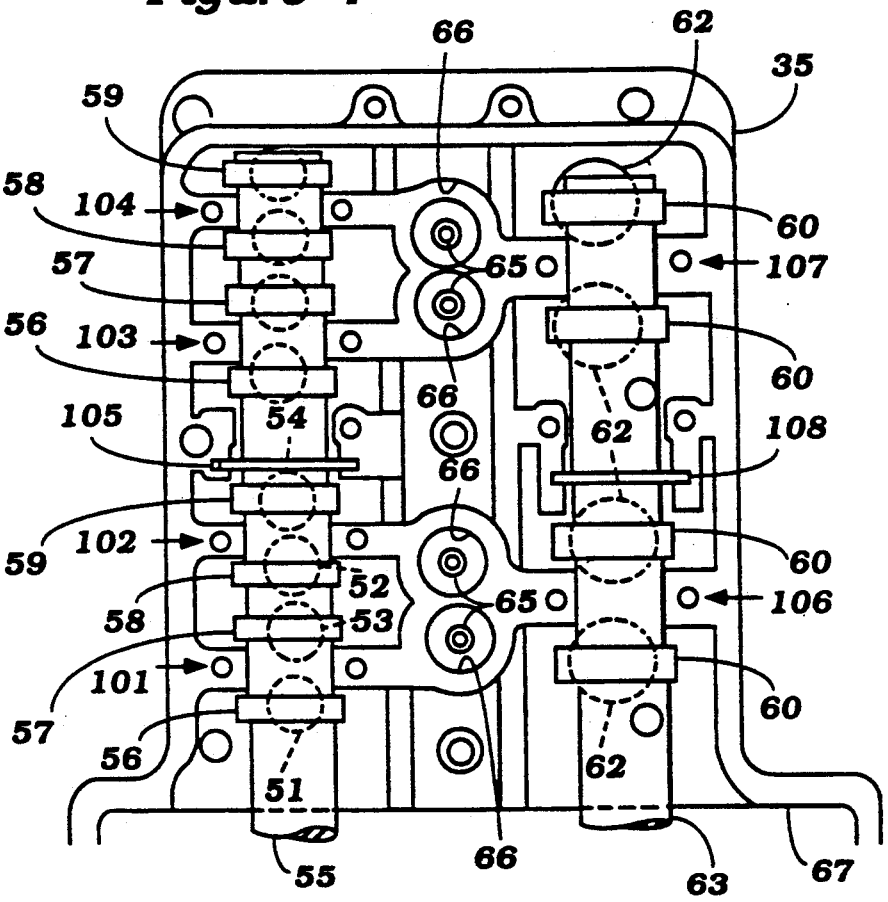
FIG. 7 is a top plan view of a cylinder head constructed in accordance with another embodiment of the engine.
Figure 8:
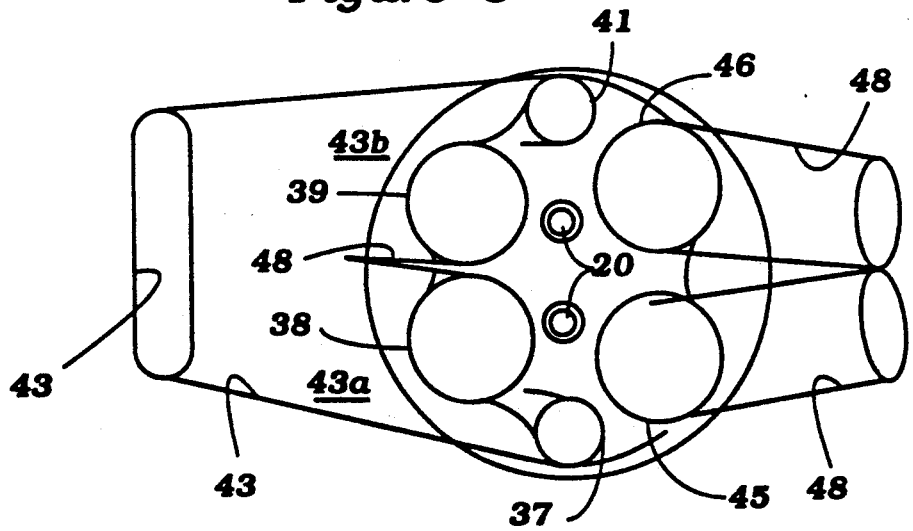
FIG. 8 is a top plan view showing the portion of the cylinder head associated with one cylinder and the valve porting arrangement in this embodiment.

In the embodiments previously described, the heads of the intake valves 38 and 39 have been smaller than or the same diameter as the head of the intake valves 37 and 41. FIGS. 7 and 8 show another embodiment of the invention in which the intake valves 38 and 39 have a larger diameter head than the intake valves 37 and 41.

In all other regards and except for the arrangement for journaling the intake camshaft 55, this embodiment may be considered to be the same as the embodiment of FIGS. 1 through 4, the embodiment of FIG. 5 or the embodiment of FIG. 6. However, it is to be understood that the spark plugs 65 may be disposed either in the orientation of the embodiments of FIGS. 4 and 6 or the embodiment of FIG. 5. In addition, for various reasons, this embodiment may be designed so that the heads of the intake valves 37 and 41 are substantially smaller than the heads of the intake valves 38 and 39 rather than vice versa, as in the embodiment of FIG. 5 or wherein the heads are all the same diameter, as in the embodiment of FIG. 6. When the valve heads 37 and 41 are made substantially smaller than the heads of the valves 38 and 39, then a swirl condition can be induced in the combustion chamber. In some instances, this is desirable. Because of these similarities, the various components which have been described are identified by the same reference numerals. Further description of these components is not believed to be necessary in view of the foregoing description.

In other words, the difference between the embodiment of FIGS. 7 and 8 and the embodiments of FIGS. 1 through 4, 5 and 6, has to do with the bearing arrangement for the intake camshaft 55 and, for that reason, only this difference will be described in conjunction with FIGS. 7 and 8.

As was noted in conjunction with the embodiment of FIGS. 1 through 4, the arrangement of the bearing surfaces on the camshaft 55 can be varied by changing the spacing between the cam lobes 56, 57, 58 and 59. In the previously described embodiment of FIGS. 1 through 4, it was explained how the spacing between the cam lobes 56 and 57, and 58 and 59 can be increased. With regard to the embodiment of FIGS. 1 through 4, the spacing generally was such that individual bearing caps 61 could be provided between each of the cam lobe pairs 56, 57; 57, 58; and 58, 59. However, by carrying the description of FIG. 3 to a further limit, it could be envisioned that the cam lobes 57 and 58 could be positioned closely adjacent each other and that a single bearing cap could be provided between the lobes 56 and 57 and the lobes 58 and 59 with no bearing cap between the lobes 57 and 58.

It will seen from FIG. 7 that the cam lobes 57 and 58 are placed quite close together and the cam lobes 56 and 57, and 58 and 59 are spaced more widely so as to provide bearing surfaces 101, 102, 103 and 104 to which the bearing caps (not shown) may be affixed for journaling the camshaft 55. There is also provided on the camshaft 55 a thrust shoulder 105 which cooperates with the cam carrier 35 to provide axial location.

It will be seen that the cam lobes 60 of the exhaust camshaft 63 are quite widely spaced apart, as with the previously described embodiment, so as to provide bearing surfaces 106 and 107 to which bearing caps (not shown) may be affixed for journaling the exhaust camshaft 63. In addition, a thrust shoulder 108 is formed on the exhaust camshaft 63 and cooperates with the cam carrier 35 so as to provide axial location.

Figure 9:
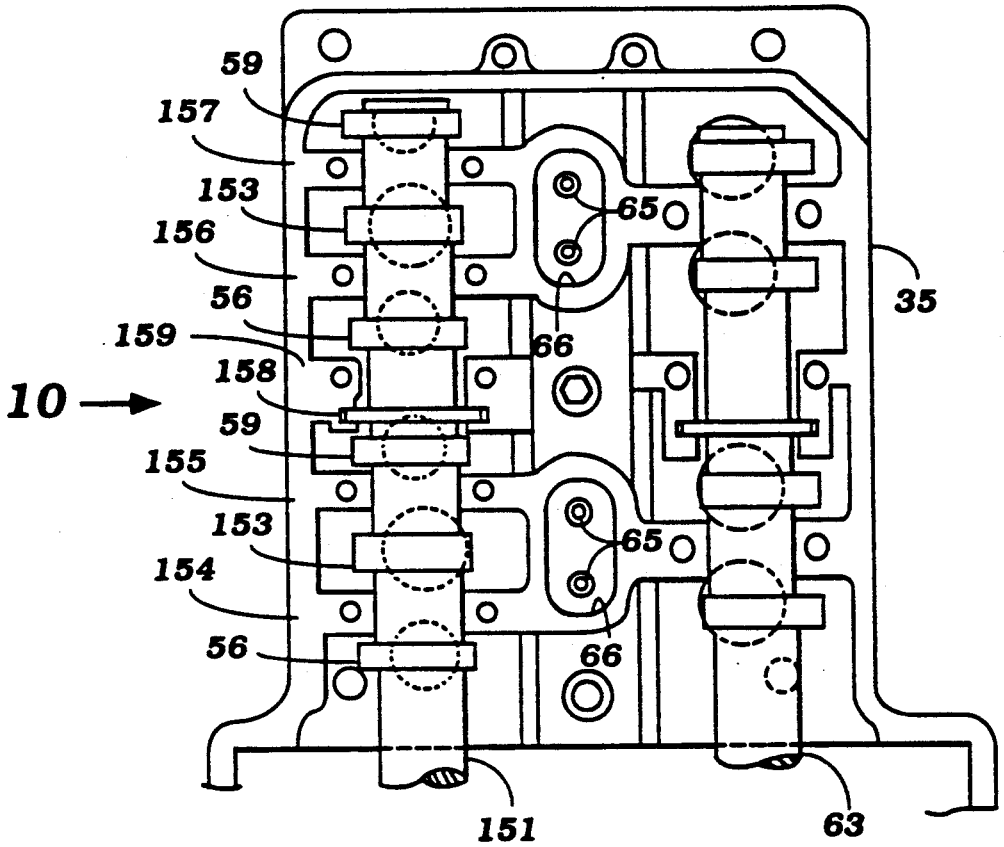
FIG. 9 is a top plan view, in part similar to FIGS. 1 and 7, of a cylinder head construction, with the cam cover removed, of another embodiment of the invention.
Figure 10:
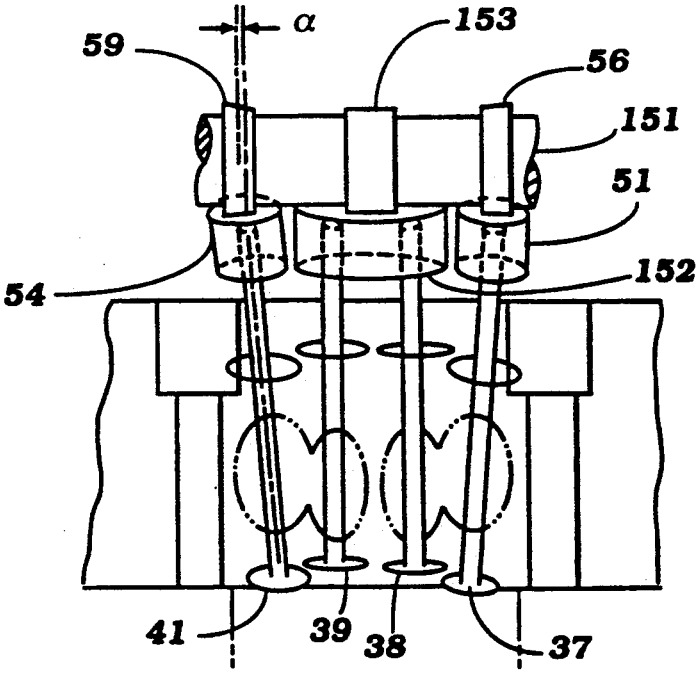
FIG. 10 is a partially schematic side elevational view, in part similar to FIG. 3, and is taken generally in the direction of the arrow 10 in FIG. 9 to show the valve orientation and valve actuation.

FIGS. 9 and 10 show another embodiment of the invention which is generally similar to the previously described embodiments. Where components are the same or substantially the same, they have been identified by the same reference numerals and will not be described again, except insofar as is necessary to understand the construction and operation of this embodiment.

In this embodiment, an intake camshaft 151 has lobes 56 and 59, as previously described, for operating the individual tappets 51 and 54 associated with the intake valves 37 and 41. Also, the cam lobes 56 and 59 are tapered and are offset so as to contact the skewed tappets 51 and 54. Furthermore, the contact between the cam lobes 56 and 59 is offset by the dimension $\alpha$ from the center line of the cam lobe so as to more widely space the cam lobes 56 and 59 from each other.

In this embodiment, however, the intake valves 38 and 39, which, as has been previously noted reciprocate about axes that lie in a common plane, share a single thimble tappet 152 that is slidably supported in an enlarged bore in the cam carrier 35. This tappet 152 encircles and engages the tips of the stems of the valves 38 and 39 as best shown in FIG. 10. There is provided a single, somewhat wider, cam lobe 153 for operating the tappet 152 and intake valves 38 and 39.

By using a single, albeit wider, cam lobe 153 for the two side intake valves 38 and 39, it is possible to provide wide bearing surfaces 154, 155, 156 and 157 between the cam lobe 153 and the cam lobes 56 and 59. Bearing caps (not shown) may be affixed to these surfaces. In addition, the camshaft 151 has a thrust surface 158 which cooperates with a bearing surface 159 to which a further bearing cap (not shown) may be affixed so as to provide axial location for the intake camshaft 151. In all other regards, this embodiment is the same as the previously described embodiments and may employ any of the features described therein.

Figure 11:
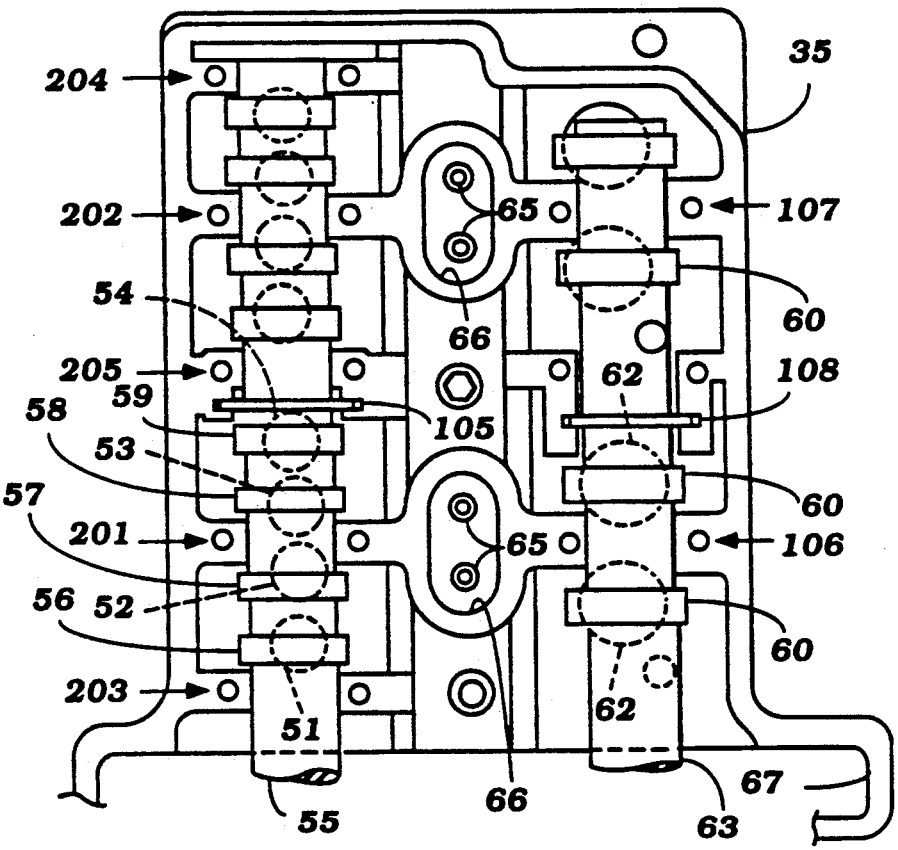
FIG. 11 is a top plan view, in part similar to FIGS. 1, 7 and 9, with the cam cover removed, showing yet another embodiment of the invention.
Figure 12:
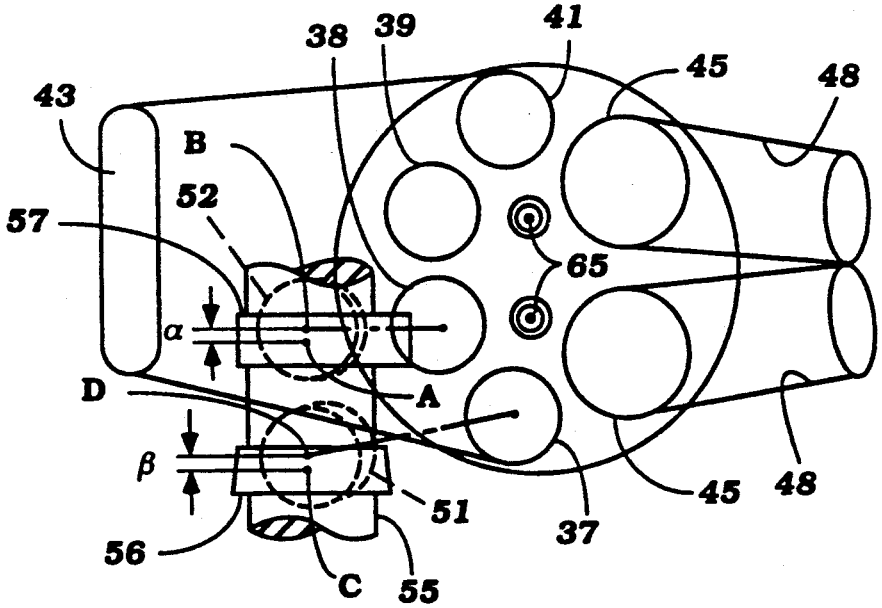
FIG. 12 is a top plan view, in part similar to FIGS. 4 and 8 of this embodiment showing the valve placement and porting arrangement.

FIGS. 11 and 12 show another embodiment of bearing arrangement for the intake camshaft. Since this embodiment is generally similar to the embodiment of FIG. 7, components in this embodiment which are the same as in that embodiment have been identified by the same reference numerals and will not be described again, except insofar as is necessary to understand the construction and operation of this embodiment.

In this embodiment, it will be noted that the cam lobes 57 and 58 are both offset away from the center of the cylinder bore so as to provide bearing areas 201 and 202 that are generally aligned with the centers of the cylinder bores and to which bearing caps (not shown) may be affixed so as to journal the intake camshaft 55. The principal of the offsetting has already been discussed and it is believed unnecessary to repeat it.

In addition to the bearing surfaces 201 and 202, the cam carrier 35 provides end bearing surfaces 203 and 204 and a central bearing surface 205 to which bearing caps (not shown) may be affixed in a known manner. In addition, the bearing surface 205 cooperates with the thrust shoulder 105 of the intake camshaft 55 for its axial location.

Figure 13:
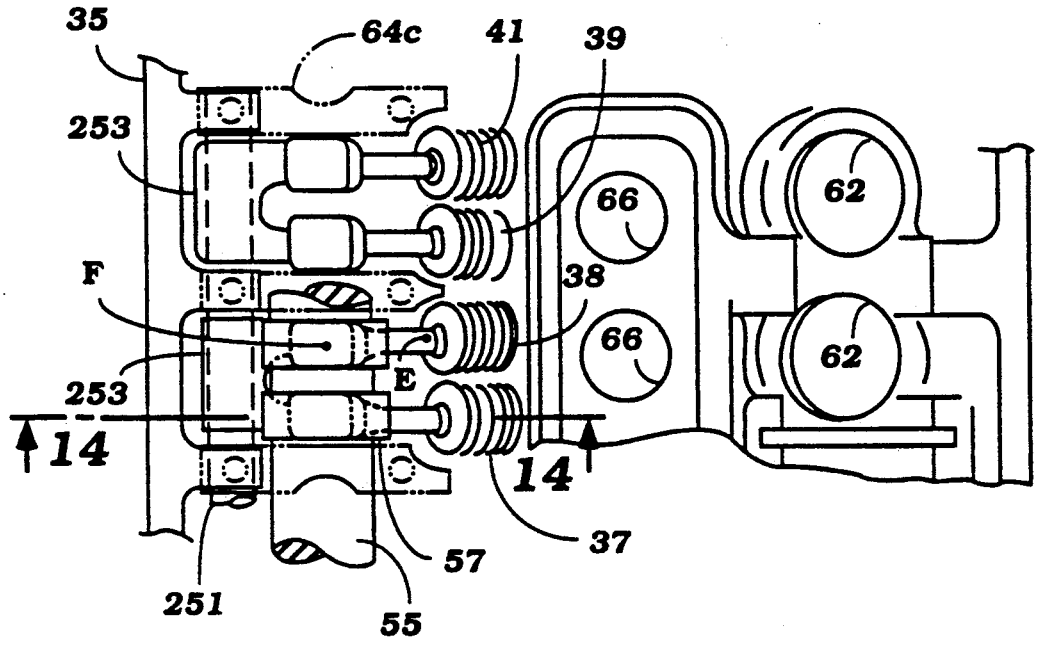
FIG. 13 is a partial top plan view, in part similar to FIGS. 1, 7, 9 and 11, showing yet another embodiment of the invention.
Figure 14:
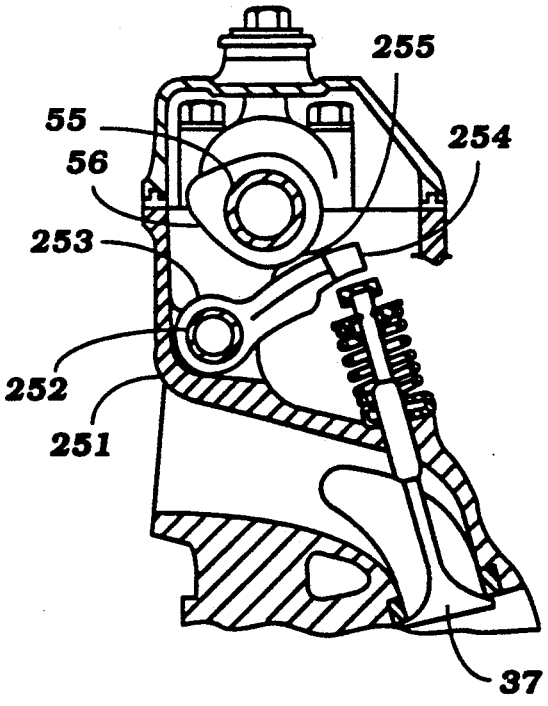
FIG. 14 is a cross sectional view taken along the line 14—14 of FIG. 13.

All of the embodiments thus far described have employed thimble tappets for operating one or more of the intake and exhaust valves. Of course, the invention can also be utilized in conjunction with engines having rocker arm valve actuation and FIGS. 13 and 14 show such an embodiment. This embodiment is generally similar to the previously described embodiments. For that reason, where components are the same or substantially the same as the previously described embodiments, they have been identified by the same reference numerals.

In this embodiment, however, the intake valves 37, 38, 39 and 41 all reciprocate about axes that lie in a common plane so as to facilitate the rocker arm operation of the valves. In this embodiment, the cam carrier and cylinder head may be formed as a single casting 251 inasmuch as the thimble tappets of the previous embodiments are not employed. The combined cylinder head casting 251 journals a plurality of rocker arm shafts 252 carrying bifurcated rocker arms 253 which have respective arms 254 that cooperate with the tips of the valves of the pairs 37, 38 and 39, 41. The intake camshaft 55 has individual cam lobes 57, 58 and so forth that cooperate with each bifurcated arm of the rocker arms 253 for their operation and so that the load is applied directly to the actuated valve. It should be noted that these bifurcated arms 254 have arcuate bearing surfaces 255 that engage the cam lobes 56, 57, 58 and 59 so as to reduce wear.

Figure 15:
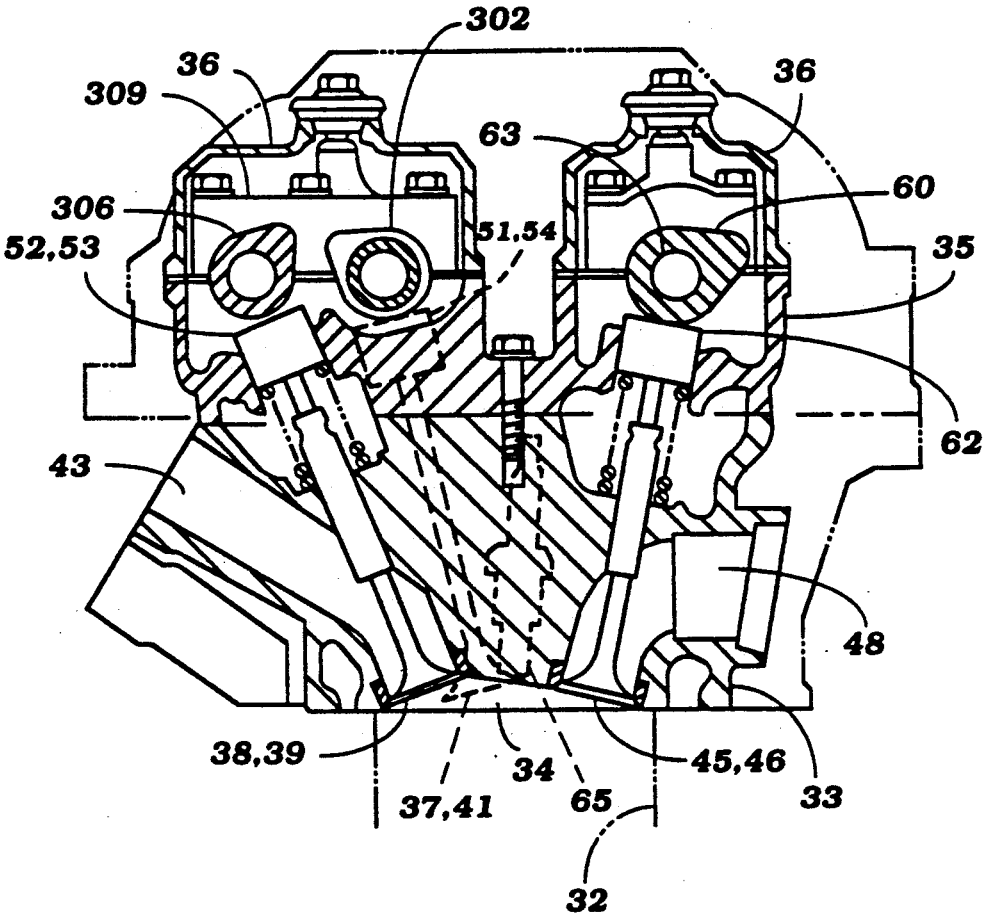
FIG. 15 is a cross sectional view, in part similar to FIG. 2, showing yet another of the invention, which view is taken along the line 15—15 of FIG. 17.
Figure 16:
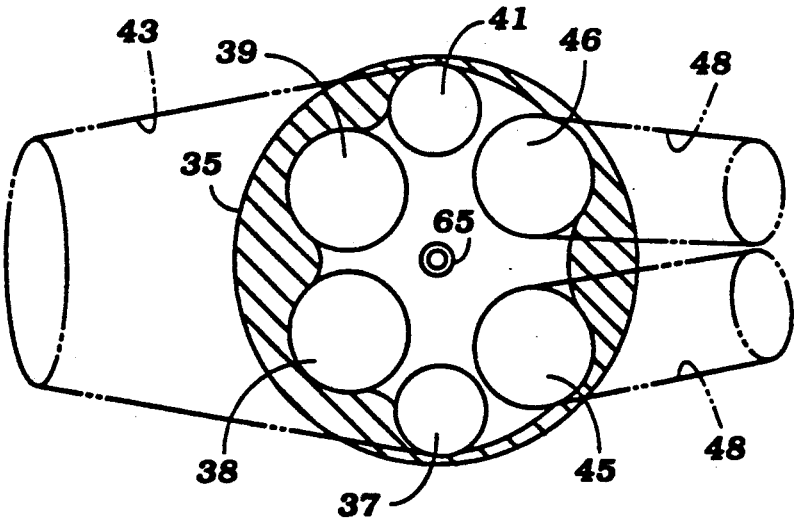
FIG. 16 is a top plan view, with portions shown in section, of the valve and porting arrangement of this embodiment.
Figure 17:
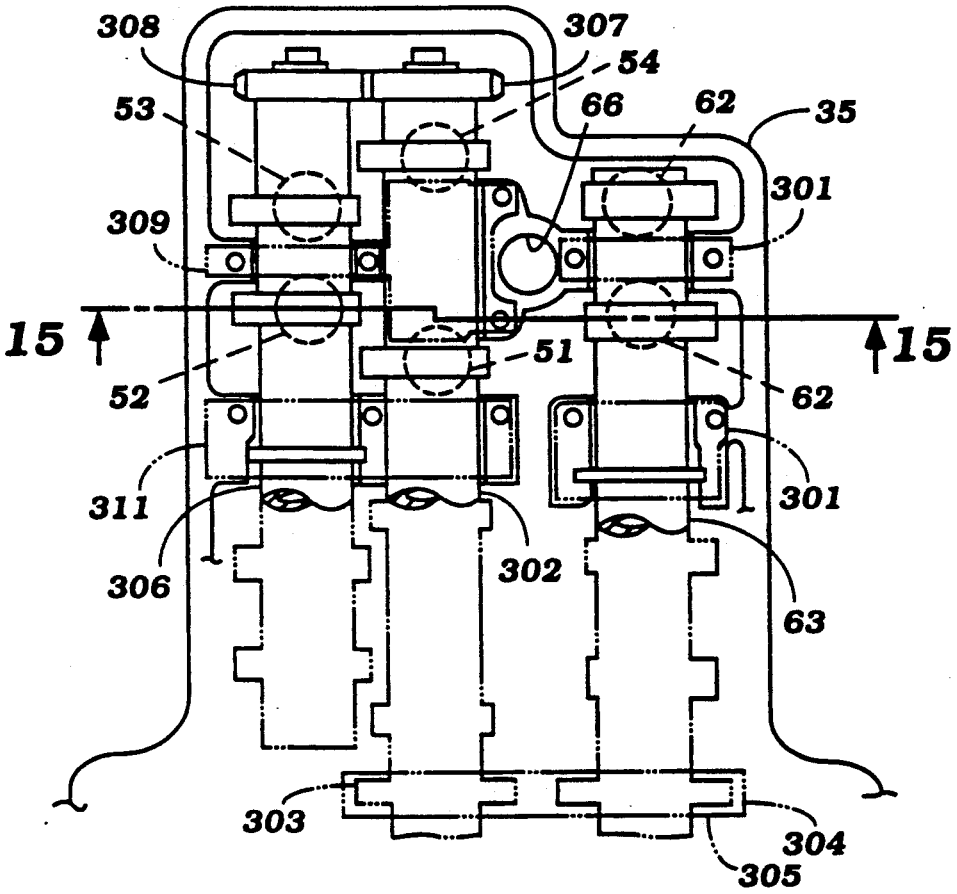
FIG. 17 is a top plan view, with portions removed and other portions shown in phantom, in part similar to FIGS. 1, 7, 9, 11 and 13, showing yet another embodiment of the invention.

In all of the embodiments as thus far described, all of the intake valves have been operated from a single camshaft. Although this facilitates and simplifies the overall construction of the cylinder head, it does necessitate the use of abnormally shaped cam lobes on the camshaft in order to permit optimum valve placement. FIGS. 15 through 17 show another embodiment of the invention wherein the valve placement and valve sizing of any of the previously described embodiments may be employed. For this reason, those components of the engine which are the same or substantially the same as previously described have been identified by the same reference numerals and for that reason will be described again only insofar as is necessary to understand the construction and operation of this embodiment.

In this embodiment, the tappets 62 associated with the exhaust valves 45 and 46 are operated by the lobes of an exhaust camshaft 63 which can have the construction of the type previously described. The exhaust camshaft 63 is journaled by means of bearing caps 301 in a manner as previously described. The center intake valves 37 and 41 and specifically the tappets 51 and 54 associated therewith are operated by means of a first intake camshaft 302. The intake camshaft 302 has a drive sprocket 303 at its forward end and a similar drive sprocket 304 is connected to the exhaust camshaft 63. The exhaust camshaft 63 and intake camshaft 302 are driven by a chain or belt 305 from the engine output shaft in a known manner.

A second exhaust camshaft indicated generally by the reference numeral 306 is supported for rotation, in a manner to be described, about an axis that is parallel to the axis of rotation of the exhaust camshaft 63 and the first intake camshaft 302. The intake camshafts 302 and 306 have affixed to the end opposite from the sprocket 303 timing gears 307 and 308 which drive the intake camshaft 306 from the intake camshaft 302. Obviously, the camshafts 302 and 306 will rotate in opposite directions and the cam lobes thereon can be formed accordingly. If desired, an intermediate gear (not shown) may be employed so that both camshafts will rotate in the same direction.

The camshafts 302 and 306 are supported for rotation relative to the cam carrier 35 by a plurality of bearing caps 309 and 311 which are affixed to the cam carrier 35 in a known manner and which cooperate with bearing surfaces on each of the camshafts 302 and 306. Alternatively, if desired, individual bearing caps may be provided.

Figure 18:
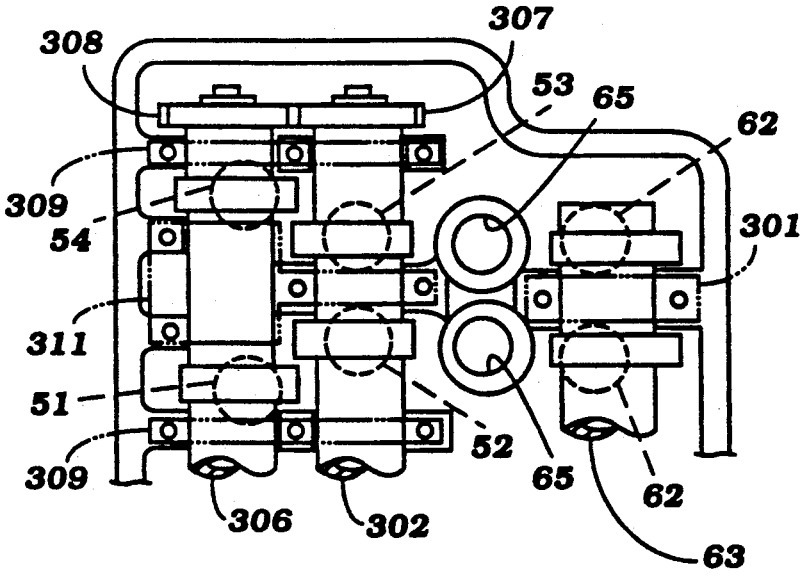
FIG. 18 is a partial top plan view, in part similar to FIGS. 1, 7, 9, 13 and 17 of a cylinder head assembly constructed in accordance with yet another embodiment of the invention, with portions broken away and with the cam cover removed.
Figure 19:
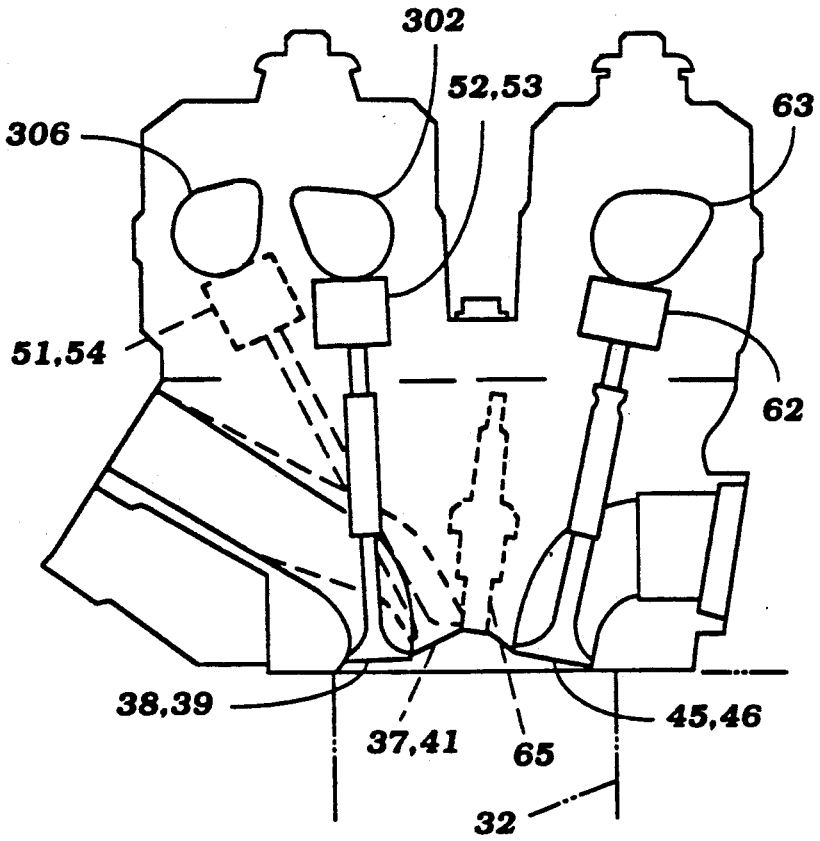
FIG. 19 is a partial cross sectional view, in part similar to FIGS. 2 and 15, of the embodiment of FIG. 18.
Figure 20:
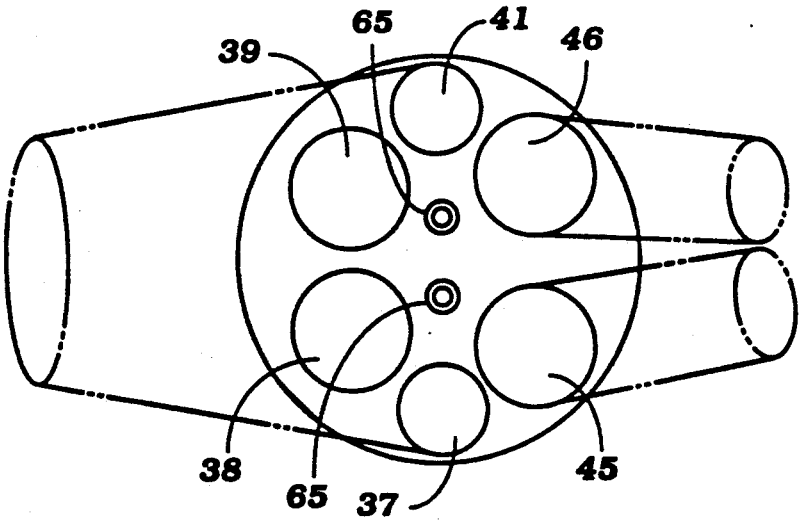
FIG. 20 is a top plan view of this embodiment showing the valve and spark plug placement in solid lines with the porting in phantom lines.

FIGS. 18 through 20 show another embodiment of the invention which is generally the same as the embodiment of FIGS. 15 through 17. With this embodiment, however, the valve placement may be different from those previously described. In this embodiment, the intake valves 37 and 41 are disposed at a rather substantial acute angle to the vertical plane passing through the axis of the cylinder 32. On the other hand, the side intake valves 38 and 39 are disposed so that their reciprocal axes are nearly vertical. This configuration permits a more compact combustion chamber and can permit higher compression ratios. As a result of this different valve placement, the camshaft 306 operates the center intake valves 37 and 41 while the first intake camshaft 32 operates the side intake valves 38 and 39. In all other regards, this embodiment is the same as that of FIGS. 15 through 17 and, for that reason, the same reference numerals have been utilized to designate the same components.

It should be readily apparent from the foregoing description that the described embodiments are highly effective in providing a high performance, six valve per cylinder engine while still maintaining a relatively simple and uncomplicated construction. Although a number of embodiments of the invention have been illustrated and described, still further changes and modifications may be made without departing from the spirit and scope of the invention, as defined by the appended claims.

I claim:

1. In a valve train arrangement for an internal combustion engine comprising a cylinder defining a bore for receiving a piston, a cylinder head affixed relative to said cylinder and having a surface defining with said bore and the piston a combustion chamber, a pair of poppet valves serving said bore and supported for reciprocation relative to said cylinder head about axes that are disposed non parallel to each other, one of said axes being inclined at an acute angle to a first plane containing the axis of said bore and lying in a second plane perpendicular to said first plane, the other of said axes being inclined at an acute angle to said first plane and also at an acute angle to said second plane, and a camshaft supported for rotation about an axis parallel to said first plane, a first cam lobe on said camshaft for operating said first valve, and a second cam lobe on said camshaft for operating said second valve, said second cam lobe having its cam surface extending in a direction inclined to the axis of rotation of said camshaft.

2. In a valve train arrangement as set forth in claim 1 wherein the cam lobes are formed with a bearing surface therebetween for rotatably journaling the camshaft.

3. In a valve train arrangement for an internal combustion engine comprising a cylinder defining a bore for receiving a piston, a cylinder head affixed relative to said cylinder and having a surface defining with said bore and the piston a combustion chamber, a pair of poppet valves supported for reciprocation relative to said cylinder head about axes that are disposed non parallel to each other, on of said axes being inclined at an acute angle only to a first plane containing the axis of said bore, the other of said axes being inclined at an acute angle to said first plane and also at an acute angle to a second plane perpendicular to said first plane and passing through said bore axis, and a camshaft supported for rotation about an axis parallel to said first plane, a first cam lobe on said camshaft for operating said first valve, a second cam lobe on said camshaft for operating said second valve, said second cam lobe having its cam surface extending in a direction inclined to the axis of rotation of said camshaft, a third valve supported for reciprocation about an axis lying in the same plane as the axis of reciprocation of said first valve and a fourth valve supported for reciprocation about an axis that is inclined at an acute angle to aid first plane and said second plane, said first and said third valves lying at a further distance from the first plane than the second and fourth valves, a third cam lobe on said camshaft for operating said third valve, and a fourth cam lobe on said camshaft for operating said fourth valve, said fourth cam lobe having its cam surface extending in a direction inclined to the axis of rotation of the camshaft.

4. In a valve train arrangement as set forth in claim 3 wherein some of the cam lobes are spaced apart further than other of the cam lobes and the camshaft is formed with bearing surfaces disposed between the more widely spaced cam lobes for journaling the camshaft for rotation.

5. In a valve train arrangement as set forth in claim 3 wherein the cam lobes are all spaced equal distance from each other and bearing surfaces are formed between each of the cam lobes for rotatably journaling the camshaft.

6. In a valve train arrangement as set forth in claim 3 further including a spark plug disposed with its gap substantially on the axis of the cylinder bore.

7. In a valve train arrangement as set forth in claim 3 further including a pair of spark plugs having their gaps lying substantially along the first plane.

8. In a valve train arrangement as set forth in claim 3 further including a pair of spark plugs supported in the cylinder head and having their gaps lying substantially along the second plane.

9. A camshaft arrangement for operating a plurality of cam followers for valves associated with a single cylinder of an internal combustion engine comprising a camshaft, a first lobe on said camshaft for operating a first of said cam followers and a second cam lobe on said camshaft for operating the second of said cam followers, the surfaces of said cam lobes engaged with said followers being offset from the center thereof for increasing the distance between said cam lobes relative to the distance between said followers to provide a greater bearing length for said camshaft between said cam lobes.

10. A camshaft drive arrangement for an internal combustion engine having an output shaft, at least three camshafts journaled for rotation about respective axes relative to said cylinder head, each of said camshafts operating a plurality of valves in said cylinder head, first drive means for driving at least one of said camshafts from said engine output shaft, second drive means for driving at least another of said camshafts from said first camshaft, and means for driving the remaining cam from only one of said first and second drive means.

11. A camshaft drive arrangement as set forth in claim 10 wherein the said first drive means drives the first and third camshafts and wherein the second camshaft is driven from the first camshaft.

12. A camshaft drive arrangement as set forth in claim 11 wherein the first drive means is disposed at one end of the first camshaft and the second drive means is spaced from the one end of the first camshaft.

13. A camshaft drive arrangement as set forth in claim 12 wherein the second drive means is disposed at the other end of the first camshaft.

14. A camshaft drive arrangement as set forth in claim 13 wherein the second drive means comprises a gear drive.

15. A camshaft drive arrangement as set forth in claim 13 wherein the first drive means comprises a flexible transmitter.

16. A camshaft drive arrangement as set forth in claim 15 wherein the second drive means comprises a gear drive.

* * * * *